US012349766B2

(12) United States Patent
Isernia

(10) Patent No.: US 12,349,766 B2
(45) Date of Patent: Jul. 8, 2025

(54) CLEATED SHOE COVER

(71) Applicant: Thomas Cono Isernia, Huntington Station, NY (US)

(72) Inventor: Thomas Cono Isernia, Huntington Station, NY (US)

( * ) Notice: Subject to any disclaimer, the term of this patent is extended or adjusted under 35 U.S.C. 154(b) by 79 days.

(21) Appl. No.: 18/136,129

(22) Filed: Apr. 18, 2023

(65) Prior Publication Data

US 2023/0404208 A1 Dec. 21, 2023

Related U.S. Application Data

(60) Provisional application No. 63/331,983, filed on Apr. 18, 2022.

(51) Int. Cl.
*A43B 5/18* (2006.01)
*A43B 3/16* (2022.01)

(52) U.S. Cl.
CPC ..... *A43B 5/185* (2013.01); *A43B 3/16* (2013.01)

(58) Field of Classification Search
CPC ..... A43B 3/16; A43B 5/18; A43B 5/185
See application file for complete search history.

(56) References Cited

U.S. PATENT DOCUMENTS 2,032,052 A * 2/1936 Friedenberg ..... A43B 5/18 36/135
2,076,316 A * 4/1937 Beals, Jr. ..... A43B 5/18 36/135
3,034,232 A * 5/1962 Bingham, Jr. ..... A43B 3/16 36/7.3
3,559,309 A * 2/1971 Taylor ..... A43B 5/185 36/7.3
3,821,858 A * 7/1974 Haselden ..... A43B 5/185 36/135
3,913,243 A * 10/1975 Arnold ..... A43B 5/185 36/135
4,434,565 A * 3/1984 Haley ..... A43C 15/06 36/59 R
4,693,019 A * 9/1987 Kim ..... A43B 3/16 36/7.1 R
5,007,185 A * 4/1991 Lazarski ..... A43B 5/14 36/131
5,172,496 A * 12/1992 Vemi ..... A43B 5/185 36/135
5,367,794 A * 11/1994 Adelstein ..... A43B 5/185 36/135

(Continued)

FOREIGN PATENT DOCUMENTS

WO WO-9634542 A1 * 11/1996 ..... A43B 5/185

*Primary Examiner* — Heather Mangine
*Assistant Examiner* — Raquel M. Weis

(57) ABSTRACT

The present disclosure provides a cleated shoe cover comprising a flexible shell forming an internal volume with a heel area and a ball and toe area, an opening for receiving a shoe, and having internal flexible, durable, tear-resistant cushioning members disposed on both the heel area and the ball and toe area. The heel area and ball and toe area are also supported by external support members. The cleats of a shoe will sink firmly into the internal tear-resistant cushioning members, gripping them in place to prevent horizontal movement within the shoe cover, while the external support members stop the flexible shell from also deforming around the cleats and thus provide the wearer with better balance.

10 Claims, 3 Drawing Sheets

(56) References Cited

U.S. PATENT DOCUMENTS

| | | | | |
|---|---|---|---|---|
| 5,600,902 | A * | 2/1997 | Yavitz | A43B 3/0078 36/7.1 R |
| 6,032,386 | A * | 3/2000 | Evans | A43B 5/185 36/15 |
| 9,635,900 | B1 * | 5/2017 | Rolle | A43B 3/20 |
| 2005/0160631 | A1 * | 7/2005 | Love | A43B 5/185 36/135 |
| 2005/0193596 | A1 * | 9/2005 | Culton | A43B 5/185 36/7.1 R |
| 2007/0006490 | A1 * | 1/2007 | Kay | A43B 3/26 36/135 |
| 2007/0113424 | A1 * | 5/2007 | Bell | A43B 13/122 36/7.6 |
| 2009/0288314 | A1 * | 11/2009 | Kay | A43B 3/18 36/7.1 R |
| 2015/0189948 | A1 * | 7/2015 | Abrams | A43B 5/185 36/73 |
| 2019/0208857 | A1 * | 7/2019 | Constantine | A43B 3/12 |
| 2023/0404208 | A1 * | 12/2023 | Isernia | A43B 3/16 |

* cited by examiner

CLEATED SHOE COVER

This patent application claims the benefit and priority of U.S. provisional application No. 63/331,983, filed 18 Apr. 2022.

FIELD OF INVENTION

The present invention relates generally to sports footwear. More specifically, the present invention relates to a cleated shoe cover having two internally integrated tear-resistant pads for protecting the cleats of a sports shoe.

BACKGROUND

Specific activities often require specialized shoes such as cleated shoes for athletics, baseball, football, soccer, rugby, lacrosse, cricket and golf. Cleats or spikes are comprised of either metal and/or hard plastic. These cleats or spikes provide additional traction for the user in sports fields and tracks.

While these shoes are optimized for their intended use, after the activity is finished these specialized shoes often provide poor traction and will damage and/or soil common flooring such as board floors and indoor carpets. The cleats themselves can also be damaged by walking on stiff surfaces such as sidewalks and roadways. Typically, the specialized shoes are removed after use in their intended activity, however this requires the user to carry two sets of shoes and also requires the removal of the specialized shoe. Competitors may forget to bring shoes without cleats or spikes, or may not take off the cleated shoes after use in the field, so the cleats wear out too quickly or soil/damage building floors.

US U.S. Pat. No. 8,453,355 B2 describes a cover for cleated shoes. The shoe cover has a ball area, a heel area, and a mid-foot area between the ball area and the heel area. At least the mid-foot area is formed of stretchable material and is thinner than the material forming the ball area and heel of the sole. An internal support member is located internally in the ball area and/or heel area of the sole.

The internal support member of U.S. Pat. No. 8,453,355 B2 can be formed as rigid or semi-rigid moulded plates, as a section of mono filament mesh, or a section of fabric. While these types of support member provide grip for the cleats on the internal surface of the cove, they do not provide adequate cushioning for the cleats to sink into so if the fit of the cover is not tight, the cleats may still move about inside, unbalancing the wearer.

It is within this context that the present invention is provided.

SUMMARY

The present disclosure provides a cleated shoe cover comprising a flexible shell forming an internal volume with a heel area and a ball and toe area, an opening for receiving a shoe, and having internal flexible, tear-resistant cushioning members disposed on both the heel area and the ball and toe area. The heel area and ball and toe area are also supported by external support members. The cleats of a shoe will sink firmly into the internal cushioning members, gripping them in place to prevent horizontal movement within the shoe cover, while the external support members stop the flexible shell from also deforming around the cleats and thus provide the wearer with better balance.

Thus, according to one aspect of the present disclosure there is provided specifically, a flexible shell having an interior surface and an exterior surface, a heel area of the flexible shell and a ball and toe area of the flexible shell, and a heel area of the interior surface and a ball and toe area of the interior surface, wherein the interior surface of the flexible shell is shaped to form an internal volume, wherein the exterior surface of the flexible shell having an opening into the internal volume, and wherein the internal volume is shaped for receiving a cleated shoe through the opening into the internal volume; and at least two cushioning elements which are configured to be durable and tear-resistant, wherein the at least two cushioning elements comprise a first cushioning element covering the heel area of the interior surface and a second cushioning element covering the ball and toe area of the interior surface; and a first support member covering an exterior surface of the heel area of the flexible shell and a second support member covering an exterior surface of the ball and toe area of the flexible shell; and wherein the first support member protrudes through the heel area of the flexible shell to support the first cushioning element, and the second support member protrudes through the ball and toe area of the flexible shell to support the second cushioning element.

In some embodiments, the first support member has a plurality of indents or protrusions formed therein for providing grip. In some embodiments, the second support member has a plurality of indents or protrusions formed therein for providing grip.

In some embodiments, the first support member comprises an outer portion disposed on the exterior surface of the heel area of the shell. The first support member may further comprise a second portion disposed on an interior surface of the shell which supports the first tear-resistant cushioning element.

In other embodiments, the first support member protrudes through the heel area of the shell to support the first tear-resistant cushioning element.

In some embodiments, the second support member comprises an outer portion disposed on the exterior surface of the ball and toe area of the shell. The second support member may further comprise a second portion disposed on an interior surface of the shell which supports the second tear-resistant cushioning element.

In other embodiments, the second support member protrudes through the ball and toe area of the shell to support the first tear-resistant cushioning element.

In some embodiments, the first tear-resistant cushioning element has a thickness greater than the thickness of the shell. In some embodiments, the second tear-resistant cushioning element has a thickness greater than the thickness of the shell.

In some embodiments, the shoe cover is formed of one or more of the following: Petroleum based rubbers, natural rubbers, silicon rubbers, stretch fabrics with elastic coatings, and stretch fabrics without elastic coatings.

BRIEF DESCRIPTION OF THE DRAWINGS

Various embodiments of the invention are disclosed in the following detailed description and accompanying drawings.

Figure 1:
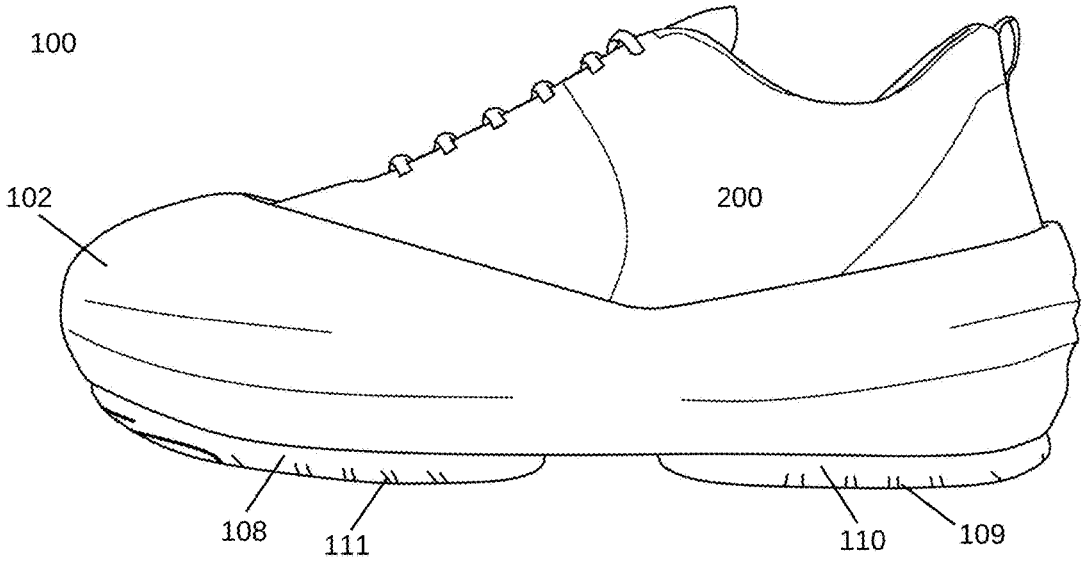
FIG. 1 illustrates a side view of an example configuration of the shoe cover of the present disclosure with a cleated shoe installed therein.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The shoe cover of the present disclosure prevents the metal/plastic studs on the bottom of such shoes from wearing down and making the cleats ineffective, removing the need for athletes to carry about pairs of non-cleated shoes to change into. This will extend the life of both the floors walked on and the cleats themselves, and in turn helps save money and improve athlete's performance on the field. It also prevents dirty shoes from soiling indoor places and cars during transportation, aiding parents and athletic complexes in helping preserve the cleanliness of their properties.

Figure 2:
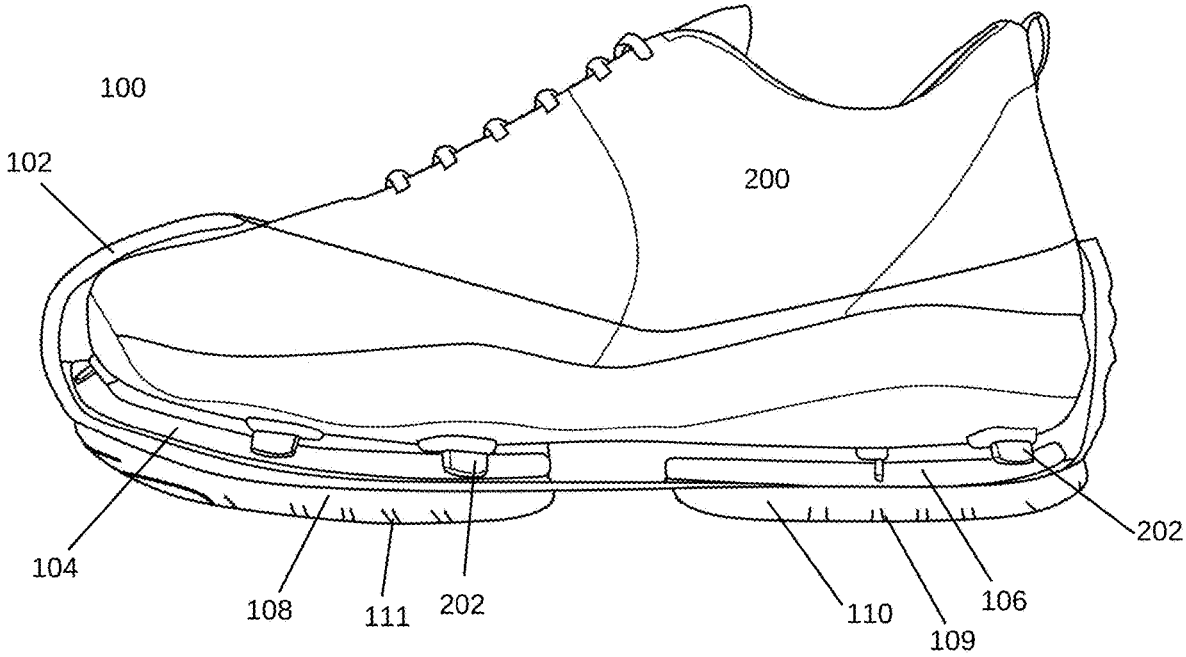
FIG. 2 illustrates a cut-away side view of the example configuration of the shoe cover and cleated shoe to show the interaction between the internal cushioning elements and cleats of the shoe.

Referring to FIG. 1 and FIG. 2, an example configuration of a shoe cover 100 according to the present disclosure is shown covering a cleated shoe 200.

The shoe cover is formed of a flexible shell 102 shaped to form an internal volume with an opening for receiving a shoe and a relatively flat heel area and ball and toe area. The flexible shell 102 is generally formed of a material such as rubber which is both durable and able to conform to the shape of different types of cleated shoe. The flexible shell generally has a cupped portion at the ball and toe area to accommodate the tip of the shoe 200. The heel area has a flatter rear wall to accommodate the shape of the rear of the shoe. The shell being flexible enables the shoe 200 to slip inside the opening more easily, being able to deform accommodate it.

Inside the flexible shell 102 there are two durable, tear-resistant cushioning elements, one cushioning element 104 (also known as the second cushioning element 104) covering the ball and toe area of the shell and another cushioning element 106 (also known as the first cushioning element 106) covering the heel area of the flexible shell. The cushioning elements may be made of materials similar to memory foam that allow for deep deformation to accommodate the cleats 202 of the shoe, but which will return to their previous undeformed shape after the cleats 202 are removed, allowing for different types of cleated shoes with cleats at different positions to be protected by the same cover. The first support member has a plurality of indents or protrusions (109) formed therein for providing grip. The second support member has a plurality of indents or protrusions (111) formed therein for providing grip.

As the cleats 202 can sink all the way into the tear-resistant internal molds at any position, the cleated shoes 200 are completely prevented from moving horizontally within the cover, improving balance when a wearer walks in the covers.

Corresponding areas on the outer surface of the flexible shell 102 are covered by gripped supporting members, one support member at the ball and toe area 108 (also known as the second support member 108) and another support member at the heel area 110 (also known as the first support member 110). These supporting members prevent the shoe cover itself from deforming around the cleats 202, and simultaneously allow for increased traction between the bottom of the cover 100 and the ground, so that a wearer does not slip when walking in them. In the present example the supporting members 108 and 110 are integrated with the flexible shell 102, extending through the flexible shell as seen in FIGS. 2-3 and providing a base onto which the cushioning elements 104 and 106 are placed.

Figure 3:
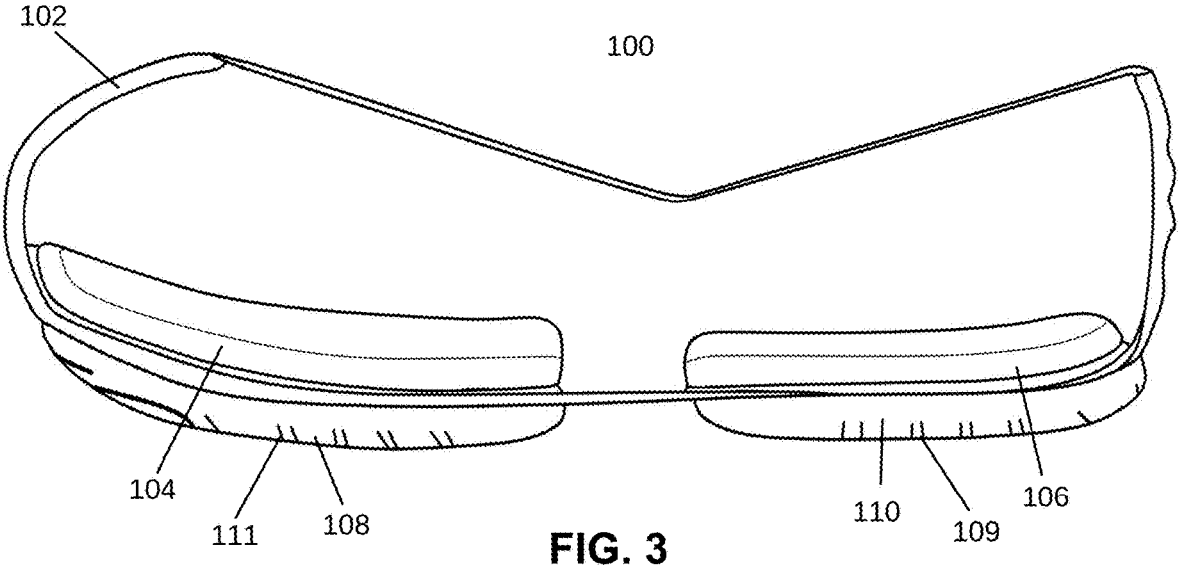
FIG. 3 illustrates a cut-away side view of the example shoe cover without the shoe installed.
Figure 4:
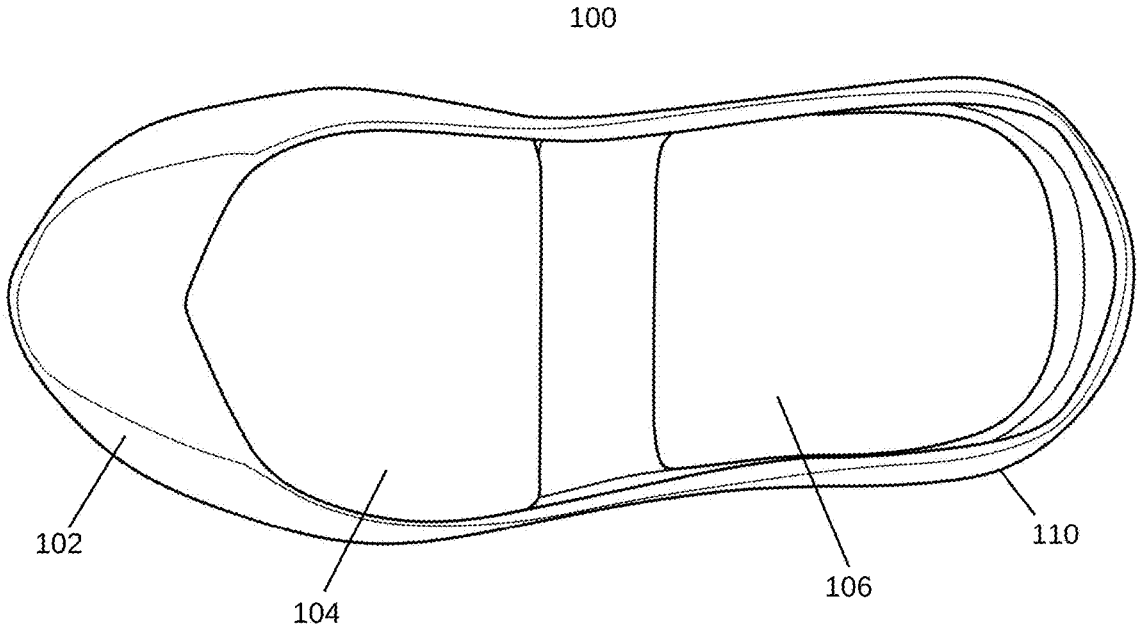
FIG. 4 illustrates a top-down view of the example shoe cover without the shoe installed.

Referring to FIG. 3 and FIG. 4, a side cutaway view and a top-down view are shown of the example configuration of the shoe cover 100 with the shoe removed.

Figure 5:
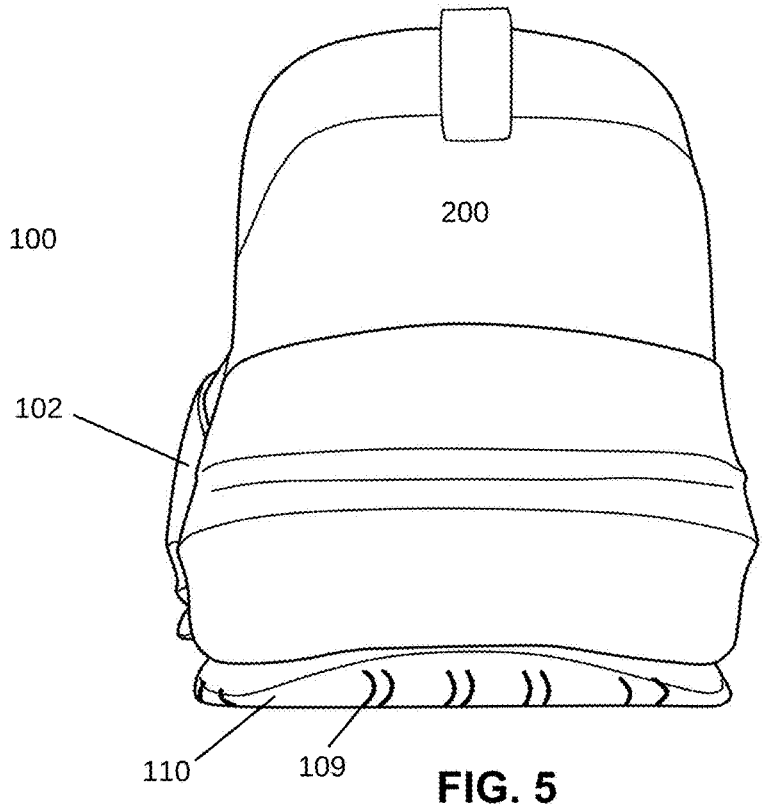
FIG. 5 illustrates a rear view of the example shoe cover with the shoe installed.
Figure 6:
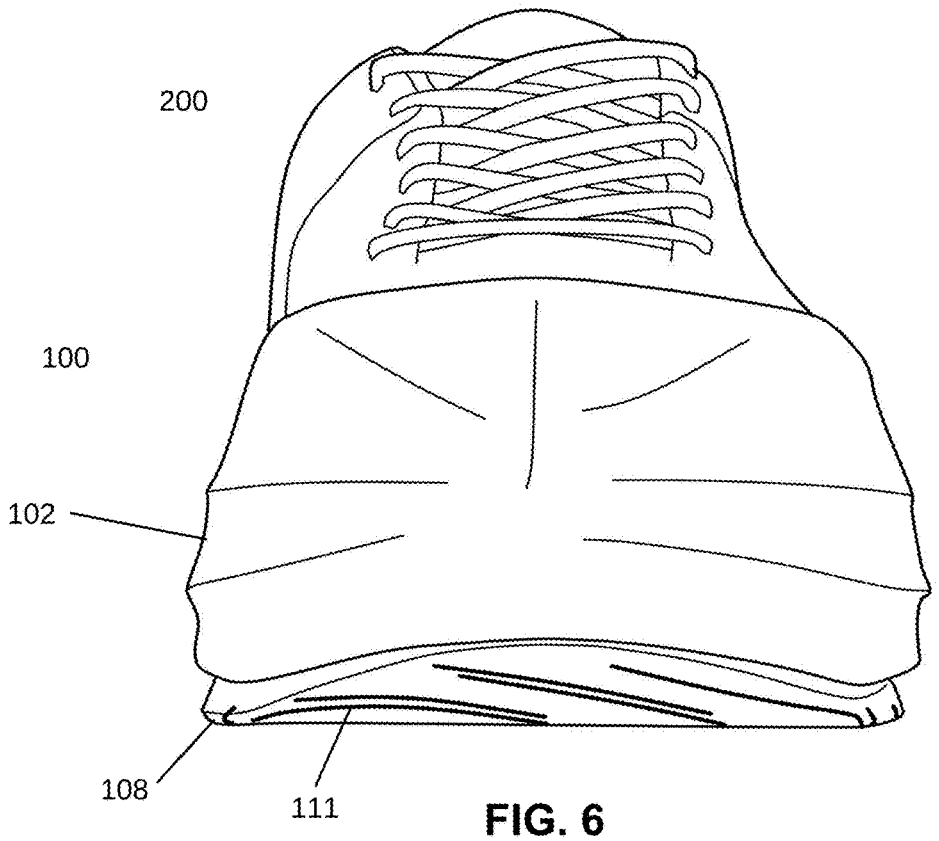
FIG. 6 illustrates a front view of the example shoe cover with the shoe installed.

Referring to FIG. 5 and FIG. 6, rear and front views of the cover 100 with the shoe 200 installed are shown.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the shoe cover have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A shoe cover for use with cleated shoes, comprising:

a flexible shell having an interior surface and an exterior surface, a heel area of the flexible shell and a ball and toe area of the flexible shell, and a heel area of the interior surface and a ball and toe area of the interior surface, wherein the interior surface of the flexible shell is shaped to form an internal volume, wherein the exterior surface of the flexible shell having an opening into the internal volume, and wherein the internal volume is shaped for receiving a cleated shoe through the opening into the internal volume; and at least two cushioning elements which are configured to be durable and tear-resistant, wherein the at least two cushioning elements comprise a first cushioning element covering the heel area of the interior surface and a second cushioning element covering the ball and toe area of the interior surface; and a first support member (110) covering an exterior surface of the heel area of the flexible shell and a second support member (108) covering an exterior surface of the ball and toe area of the flexible shell;

and wherein the first support member protrudes through the heel area of the flexible shell to support the first cushioning element, and the second support member protrudes through the ball and toe area of the flexible shell to support the second cushioning element.

2. The shoe cover for use with cleated shoes according to claim 1, wherein the first support member has a plurality of indents or protrusions (109) formed therein for providing grip.

3. The shoe cover for use with cleated shoes according to claim 1, wherein the second support member has a plurality of indents or protrusions (111) formed therein for providing grip.

4. The shoe cover for use with cleated shoes according to claim 1, wherein the first support member comprises an outer portion disposed on the exterior surface of the heel area of the flexible shell.

5. The shoe cover for use with cleated shoes according to claim 1, wherein the first support member further comprises a second portion disposed on the interior surface of the flexible shell which supports the first cushioning element.

6. The shoe cover for use with cleated shoes according to claim 1, wherein the second support member comprises an outer portion disposed on the exterior surface of the ball and toe area of the flexible shell.

7. The shoe cover for use with cleated shoes according to claim 6, wherein the second support member further comprises a second portion disposed on the interior surface of the shell which supports the second cushioning element.

8. The shoe cover for use with cleated shoes according to claim 1, wherein the first cushioning element has a thickness greater than the thickness of the flexible shell.

9. The shoe cover for use with cleated shoes according to claim 1, wherein the second cushioning element has a thickness greater than the thickness of the flexible shell.

10. The shoe cover for use with cleated shoes according to claim 1, wherein the shoe cover is formed of one or more of the following: petroleum-based rubbers, natural rubbers, silicon rubbers, stretch fabrics with elastic coatings, and stretch fabrics without elastic coatings.

* * * * *